US005280715A

United States Patent [19]

Baldwin

[11] Patent Number: 5,280,715

[45] Date of Patent: Jan. 25, 1994

[54] LIFTING ARRANGEMENT AND METHOD

[75] Inventor: John B. Baldwin, Warrenville, Ill.

[73] Assignee: Caterpillar Inc., Peoria, Ill.

[21] Appl. No.: 819,694

[22] Filed: Jan. 13, 1992

[51] Int. Cl.[5] ..... B21D 37/04; B21J 13/08

[52] U.S. Cl. ..... 72/446; 72/389; 414/626; 414/671; 483/28

[58] Field of Search ..... 483/28, 29; 72/446, 72/389; 414/561, 626, 667, 671

[56] References Cited

U.S. PATENT DOCUMENTS

| | | | |
|---|---|---|---|
| 3,135,397 | 6/1964 | Kull | 214/1 |
| 4,649,622 | 3/1987 | Scott | 29/568 |
| 4,668,154 | 5/1987 | Ueno et al. | 414/671 |
| 5,174,708 | 12/1992 | Ruder et al. | 414/667 |
| 5,176,023 | 1/1993 | Baldwin | 72/446 |

FOREIGN PATENT DOCUMENTS

| | | | |
|---|---|---|---|
| 277078 | 8/1988 | European Pat. Off. | 414/626 |
| 226267 | 8/1985 | Fed. Rep. of Germany | 414/626 |
| 6004 | 1/1990 | Japan | 72/446 |
| 870189 | 10/1981 | U.S.S.R. | 72/446 |

*Primary Examiner*—David Jones
*Attorney, Agent, or Firm*—Alan J. Hickman

[57] ABSTRACT

A lifting frame assembly having first and second spaced hooking members adjustably carried on a second portion of the lifting frame assembly is connectable to work tools of different sizes. The lifting frame assembly is connected to a lifting device by a lever arm which causes the lifting frame assembly to hang at an acute angle relative to a vertical plane so that the work tool may be aligned relative to a tool holder of a machine tool without interference. A first end portion of the lifting frame assembly is extensible in order to traverse the length of a ram of the machine tool and further improve alignment capabilities with the tool holder.

26 Claims, 7 Drawing Sheets

LIFTING ARRANGEMENT AND METHOD

DESCRIPTION

1. Technical Field

This invention relates to a lifting frame assembly for connecting a lifting device to a work tool and more particularly to a lifting arrangement and method for facilitating the positioning of the work tool relative to a tool holder of a machine tool.

2. Background Art

Work tools, such as dies, punches, bits and the like, are utilized on a machine tools, such as presses, boring and milling machines and the like. Such work tools which vary in size are frequently changed to accommodate changes in the particular operation to be performed. For example, in applications such as metal forming, dies of a press brake may be changed several times a day to accommodate changes in the stock being formed. In order to accomplish a die change it is necessary to replace the die set connected to the press brake with the appropriate die set. To do so requires that the die set be removed from connection to the ram and bed and transported to and deposited at a storage area. The replacement die set is then transported to the press brake and connected thereto.

The die set is often transported between the storage area and the brake press by a fork lift truck, overhead crane and the like. The die set is then normally maneuvered manually into position, with a substantial degree of difficulty. Typically the die set positioned is quite large and heavy and difficult to move for alignment with the tool (die) holder on the press brake. The die set is usually connected to the cable of the hoist of the overhead crane by a chain connected to the die set. Interference between the ram of the brake press and the cable and chain of the hoist restricts alignment with the die holder and causes additional difficulty in positioning of the die set relative to the die holder. Further, holding of the die set in alignment with and against the die holder is inhibited by this interference.

Attempts have been made to provide devices to assist in the placement and holding of metal working tools relative to the tool holder. An example of such a device is shown in U.S. Pat. No. 3,135,397 to A. R. Kull dated Jun. 1, 1964. The Kull patent provides a die lifter which is mounted on a forging press. The die lifter includes a jack assembly which powers an arm supporting a die lifting fixture. The die lifting fixture is connectable to the die. The arm is pivotally and elevationally movable. Elevational movement is in response to actuation of the jack assembly and pivotal movement is manual. Although this assists in positioning the die relative to the forging press the cost for such a device is excessive. Because the die lifter design has a large number of exposed parts inadvertent damage caused by impact during material handling is likely. Further, because the die lifter has numerous exposed movable parts premature wear is caused by dirt, grit and the like will result in improper operation. Also the device is limited to use on a single forging press and because of this it has not been widely used.

The present invention is directed to overcoming one or more of the problems as set forth above.

DISCLOSURE OF THE INVENTION

In one aspect of the present invention, a lifting frame assembly for connecting an elevationally movable lifting device to a metal working tool is provided. The lifting frame includes a first frame portion having first and second spaced end portions and a longitudinal axis extending between the first and second spaced end portions. The first and second end portions are movable relative to each other along the longitudinal axis between predetermined extended and retracted positions. The lifting frame also includes a second frame portion having a longitudinal axis. The second frame portion is connected to the first end portion of the first frame portion and extends axially transversely relative to the longitudinal axis of the first frame portion. First and second spaced hooking members are connected to the second frame portion. The first and second hooking members are oriented transversely relative to the longitudinal axis of the second frame portion and to a predetermined side of the second frame portion. The first and second hooking members are adapted to engage and carry a metal forming tool. A lever arm member having first and second spaced end portions is connected at the first end portion to the second end portion of the first frame portion. The lever arm member extends from the first frame portion to the same side of the second frame portion as the first and second hooking members. The second end portion of the lever arm member is connectable to an elevationally movable lifting device.

In another aspect of the present invention, a lifting arrangement includes a lifting device having an elevationally movable lifting member. A machine tool has an elevationally movable ram, a table spaced beneath the ram, and a tool holder connected to the ram. The tool holder is elevationally located between the ram and table. A metal working tool having a connecting portion is connectable to the tool holder. A lifting frame assembly has first and second frame portions, first and second hooking members, and a lifting arm. The first frame portion has first and second end portions relatively movable between extended and retracted positions. The second frame portion has first and second spaced end portions. The second frame portion is connected to the first end portion of the first frame portion and the first and second hooking members are connected to the first and second end portions, respectively, of the second frame portion. The first and second hooking members extend from the second frame portion on a preselected side of the lifting frame. The lever arm member has first and second end portions and is connected at the first end portion to the second end portion of the first frame portion. The lever arm member extends transversely relative to the first frame portion on the preselected side of the lifting frame. The second end portion of the lever arm member is connected to the elevationally movable lifting member. The first frame portion is movable from the retracted position to the extended position in response to elevational movement of the lifting member. The second frame portion is elevationally movable in response to subsequent elevational movement of the lifting member. The first and second hooking members connect the metal working tool to the second frame portion and facilitate selective alignment of the metal working tool relative to the tool holder.

In yet another aspect of the present invention, a lifting arrangement for supporting a die at a preselected location relative to a lower end of a ram of a press in provided. The lifting arrangement includes a crane having an elevationally movable lifting member. The ran has an upper end elevationally spaced from the ram lower end and a die holding clamp at the lower end. The die has first and second spaced extensions, a connecting portion, and is connectable at the connecting portion to the ram lower end. A lifting frame assembly has first and second connected frame portions. The first frame portion has an end portion and is telescopically extensible between extended and retracted positions. First and second spaced hooking members are connected to the second frame portion. A lifting arm is connected to the end portion of the first frame portion. Said hooking members and lifting arm are oriented to a common side of the frame assembly to enable the die to be easily positioned beneath the lower end of the ram. The elevationally movable lifting member is connected to the lifting arm and the first and second spaced hooking members are engageable with the first and second extensions. The first frame portion is adapted to traverse the distance between the upper and lower ends of the ram at the extended position and support the die to be positioned adjacent the lower end of the ran. The die is connectable to the ram by the die holding clamp.

In yet another aspect of the present invention, a method for transporting a die from a stored position to a position adjacent a ram of a press by a lifting frame assembly is provided. The die has first and second extensions. The lifting frame assembly has a first end portion telescopically movable relative to a second end portion between extended and retracted positions and spaced hooking members connected to the second frame portion. Said method comprising the steps of: extending the first frame portion of the lifting frame assembly from the retracted position to the extended position and elevating the second frame portion of the lifting frame assembly to a desired height; positioning the second frame portion of the lifting frame assembly to a location adjacent the die to be lifted; connecting the first and second spaced hooking members of the lifting frame assembly to the first and second die extensions; elevating the second frame portion of the lifting frame assembly to a desired height; moving the die to a location adjacent the ram of the press; clamping the die to the ram; and removing the lifting frame assembly from connection with the first and second die extensions.

The lifting frame assembly facilitates placement of the work tool adjacent the tool holder with ease and substantially reduces the amount of physical effort required by the operator. Because of the aforementioned construction the lifting device hangs on an incline. As a result interference between the ram and lifting device is eliminated and the work tool is easily positionable between the ram and table.

Further, because the first frame portion is movable between extended and retracted positions the lifting frame assembly is able to traverse the entire length of the ran and thus eliminate the potential for interference between the lifting member and the ram. Movement of the first frame portion to the retracted position facilitates compactness of the lifting frame assembly for storage purposes.

Since the first and second hooking members are positionable axially on the second frame portion the lifting frame assembly is suitable for engaging and carrying of dies of differing lengths.

BEST MODE FOR CARRYING OUT THE INVENTION

Figure 1:
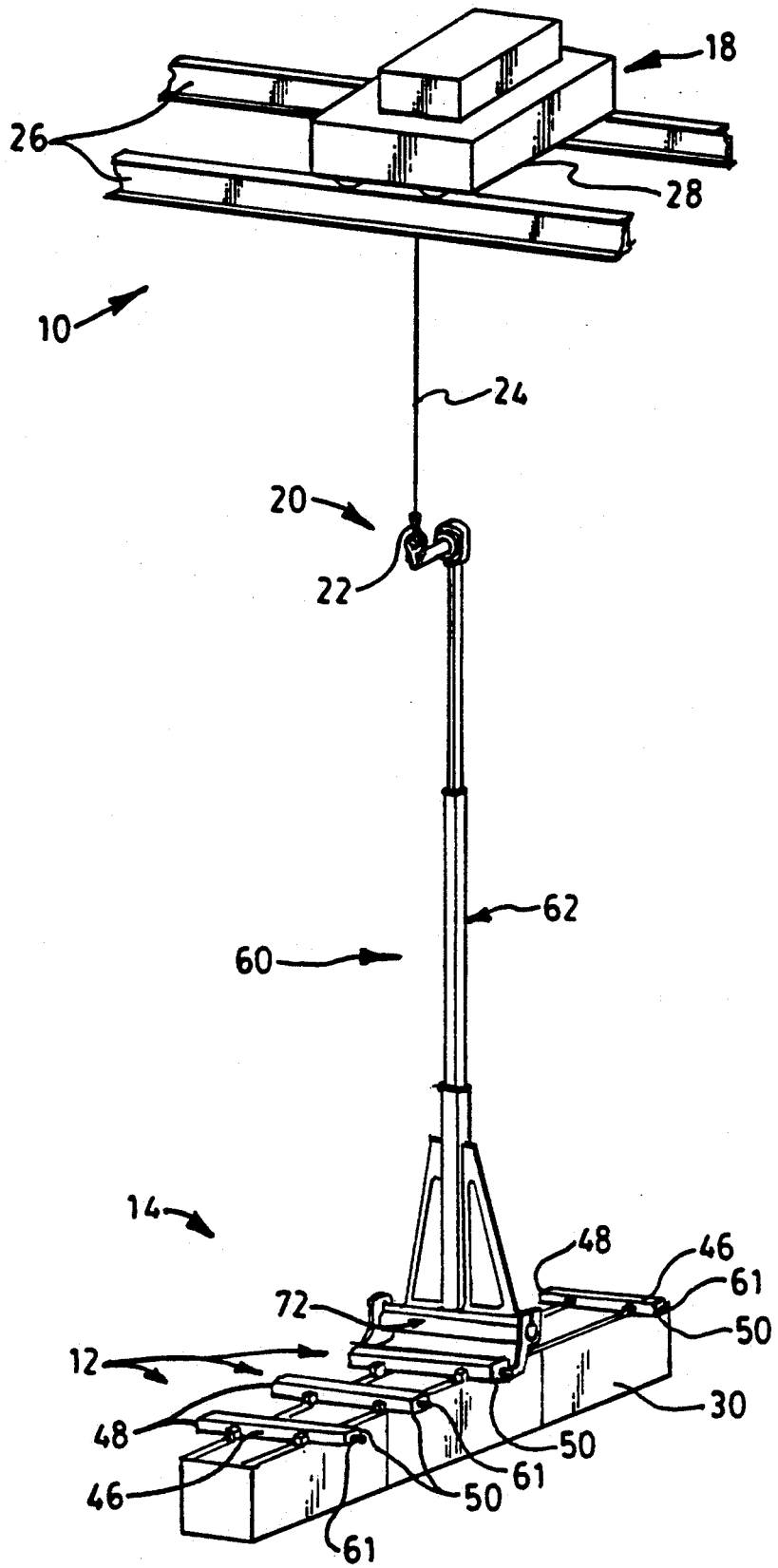
FIG. 1 is a diagrammatic isometric view of an embodiment of the lifting arrangement of the present invention positioned adjacent a storage location.
Figure 2:
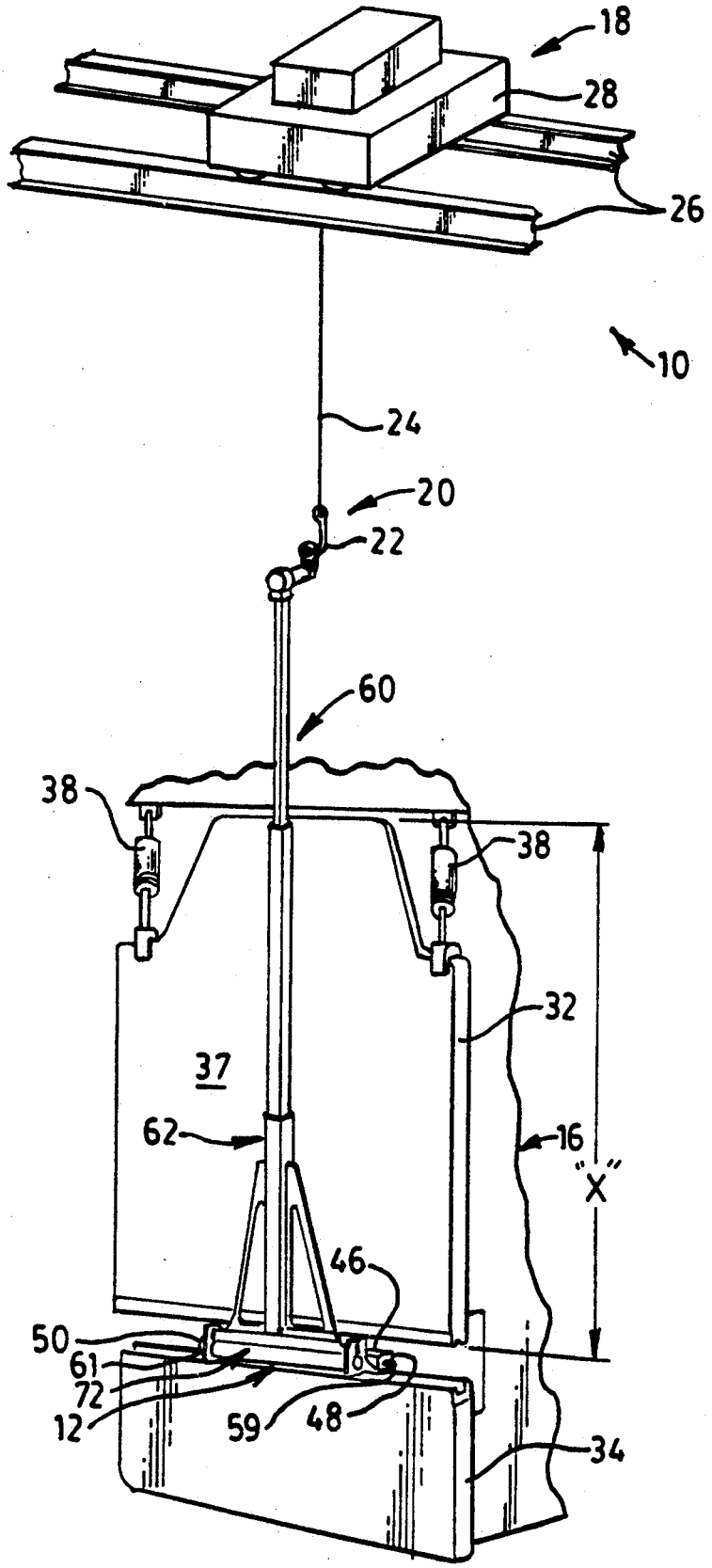
FIG. 2 is a diagrammatic isometric view of the embodiment of the lifting arrangement of FIG. 1 positioned adjacent a machine tool.

With reference to the drawings, and particularly FIGS. 1 and 2 a lifting arrangement 10 is provided for transporting a tool 12 for working metal between a storage location 14 and a machine tool 16. In particular the lifting arrangement 10 includes a lifting device 18, for example an over head crane, having an elevationally movable lifting member 20, such as a hook 22.

The lifting device 18 includes a winch having a drum powered for rotation by an electric motor (all not shown) and a cable 24 windable about the drum. The hook 22 is connected to an end portion of the cable 24 and elevationally movable in response to rotation of the drum and under the control of an operator. Winches of this type are well known in the art and therefore will not be discussed in any greater detail. It should be noted that other types of lifting devices such as telescopic masts, rams and the like may be substituted for the winch without departing from the invention. The lifting device 18 has a pair of spaced parallel guide rails 26 and a carriage 28 supported on and rollingly movable along the guide rails 26. The winch is connected to the carriage 28 and movable along the guide rails 26 with the carriage 28. The pair of guide rails 26 may be replaced by a single rail without departing from the invention. The carriage 28 may be powered by an electric motor for movement along the guide rail 26 or manually pulled along by an operator.

As shown in FIG. 1, the storage location 14 includes a rack, bin, or the like 30 of any suitable design capable of supporting the work tool 12, such as a die, punch, drill, hob and the like, in an organized and accessible manner. The work tool 12 shown herein is a die for use in bending metal stock.

As best seen in FIG. 2 and 14, the machine tool 16 shown herein is a press brake having a ram 32 with upper and loser ends, a bed or table 34, and a tool holder 36 connected to the lower end of the ram 32. The ram 32 is elevationally movable relative to the table and powered by a pair of extensible jacks 38 preferably of the fluid operated type. The jacks 38 are preferably selectively actuatable and under the control of a machine tool operator but may be controlled in any other suitable manner such as by computer. The height "X" of the ran 32 is normally substantial and a face 37 thereof is flat. This makes it difficult to change the work tool from above or to access the area between the ram 32 and table 34.

As shown in FIGS. 2-5, the tool holder 36 is of any suitable design capable of holding and releasing the particular work tool 12 disclosed herein. In the particular press brake application the the tool holder 36 is of a clamp type having a pair of facing jaws 40,42 defining a "T" shaped slot therebetween. The tool holder 36 is elevationally located between the ram 32 and table 34. One of the jaws 40 is movable relative to the other jaw 42 and is urgeable relative toward the jaw 42 to clamp the work tool 12 therebetween. In the particular application disclosed herein a plurality of threaded fasteners 44 are provided for urging jaw 40 toward stationary jaw 42. It is to be recognized that other means of urging jaw 40 toward jaw 42, for example, springs, fluid pressure, and other equivalents are available in the art and within the scope of the invention.

The metal working tool 12 shown in the FIGS. 1-5 and 14 as a die has an elongated body 46, first and second spaced ends 48,50, a flat surface 52, a stock engaging surface 54 opposite the flat surface 52 and a connecting portion 56 extending from the flat surface 52. The connecting portion 56 has a "T" or inverted "L" shaped configuration and is disposable in the "T" shaped slot of the jaws 40,42. By virtue of these shapes and the clamping force of jaws 40,42 the work tool 12 is connectable to the ram 32. The flat surface 52 of the work tool 12 bears against and end surface 58 of the tool holder 36 and resists tipping of the work tool 12. First and second spaced apart extensions 59,61 are connected to the first and second spaced ends 48,50, respectively. The extensions 59,61 are provided for connection to the lifting device 18.

Figure 6:
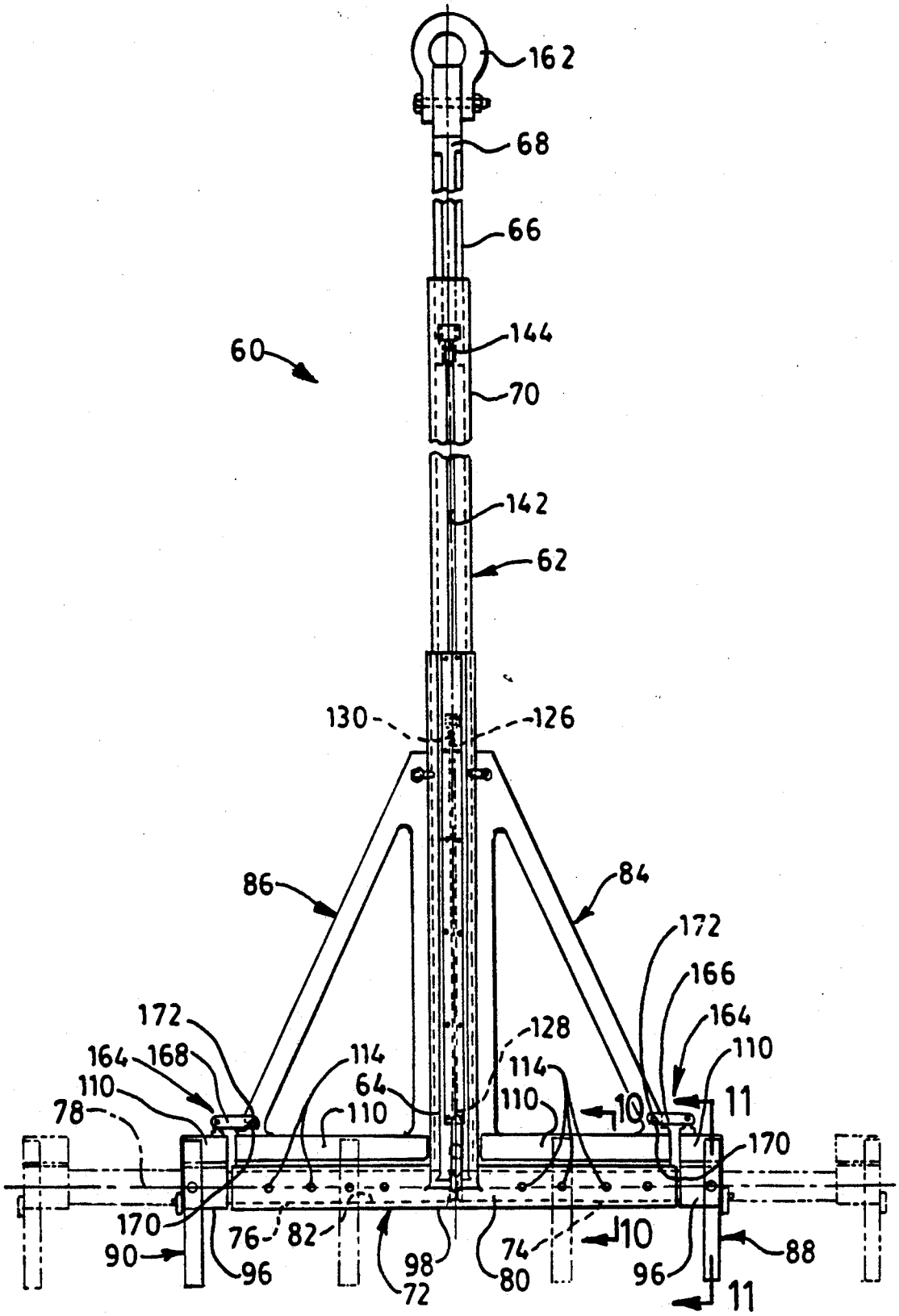
FIG. 6 is a diagrammatic plan view of the lifting frame assembly showing the lifting frame assembly in greater detail.
Figure 7:
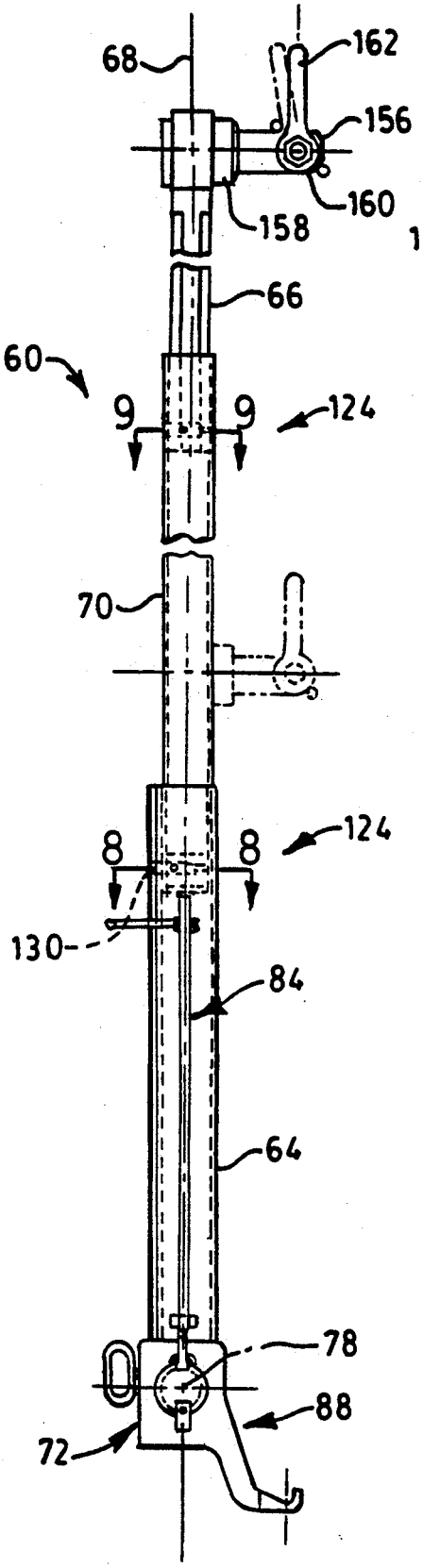
FIG. 7 is a diagrammatic side elevational view of the lifting frame assembly of FIG. 6.

As best seen in FIGS. 6 and 7, a lifting frame assembly 60 is provided for connecting the elevationally movable lifting device 18 to the work tool 12. The frame assembly 60 has a first frame portion 62 having first and second spaced elongated members defining first and second end portions 64,66 and a longitudinal axis 68. The first and second end portions 64,66 are movable relative to each other along the longitudinal axis 68 between predetermined extended and retracted positions. The predetermined positions are a function of the length of each of the first and second end portions 64,66 and when required a middle portion 70. The first and middle portions 64,70 are tubular and rectangular in cross section. The middle portion 70 is telescopically slidable in the first end portion 64 and the second end portion 66 which is substantially rectangular bar stock is telescopically slidable in the middle portion 70. The length of the first frame portion 62 at the extended position is greater in magnitude than the length "X" of the ram 32 so that the potential for interference between the ram 32 and lifting frame assembly is reduced.

The lifting frame assembly 60 also has a second frame portion 72. The second frame portion 72 has first and second spaced end portions 74,76 of cylindrical steel stock and a longitudinal axis 78 extending between the first and second end portions 74,76. The second frame portion 72 has a middle portion 80 of tubular steel stock with a cylindrical bore 82 disposed therein. The first and second frame portions are slidably disposed in the middle portion 80 and movable along the axis 78 between extended and retracted portions. The second frame portion 72 and particularly the middle portion 80 thereof is connected to the first end portion 64 of the first frame portion 62 and extends axially transversely relative to the longitudinal axis 68 of the first frame portion 62. The axes 68 and 78 are preferably perpendicular to each other.

First and second triangularly configured gussets 84,86 are each connected to the first end and middle portions 64,80 by welding. The gussets 84,86 stiffen the lifting frame assembly 60 and maintain the axes 68,78 substantially perpendicular to each other.

As best seen in FIGS. 6 and 7, first and second spaced hooking members 88,90 are supported on the second frame portion 72 and adjustably movable along axis 78. The first and second hooking members 88,90 are oriented transversely relative to the longitudinal axis 78 of the second frame portion 72 and to a predetermined and common side of the second frame portion 72 as viewed in FIG. 7. The hooking members 88,90 are made from plate steel and each have a bore 92 disposed normally through the plate material.

The first and second end portions 74,76 of the second frame portion 72 include diametrically enlarged cylindrical end surface portions 96 having a diameter substantially equal in magnitude to the outer diameter 98 of the raiddle portion 80. The enlarged end portions 96 are disposed in the bores 92. With the first and second end portions 74,76 in the retracted position, the first and second hooking members 88,90 are slidably axially positionable along the cylindrical surface 96 of the first and second end portions 74,76, respectively, and on the outer surface 98 of the middle portion.

Figure 10:
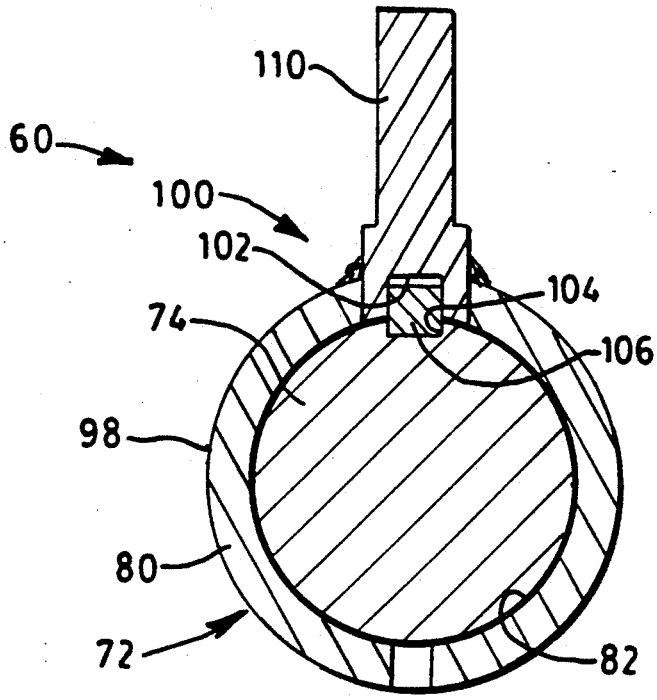
FIG. 10 is a diagrammatic cross section view taken along lines 10—10 of FIG. 6.

As best seen in FIG. 10, means 100 is provided for maintaining the first and second cylindrical end portions 74,76 from rotation in the cylindrical bore 82 of the middle portion 80. The means 100 includes first and second slots or ways 102 disposed in the middle portion 80, first and second slots or ways 104 disposed in the first and second end portions 74,76, and first and second keys 106 disposed in the first and second slots and ways 104,106, respectively. The slots and ways 104,106 are radially disposed and axially oriented in their respective portions 74,76,80.

Figure 11:
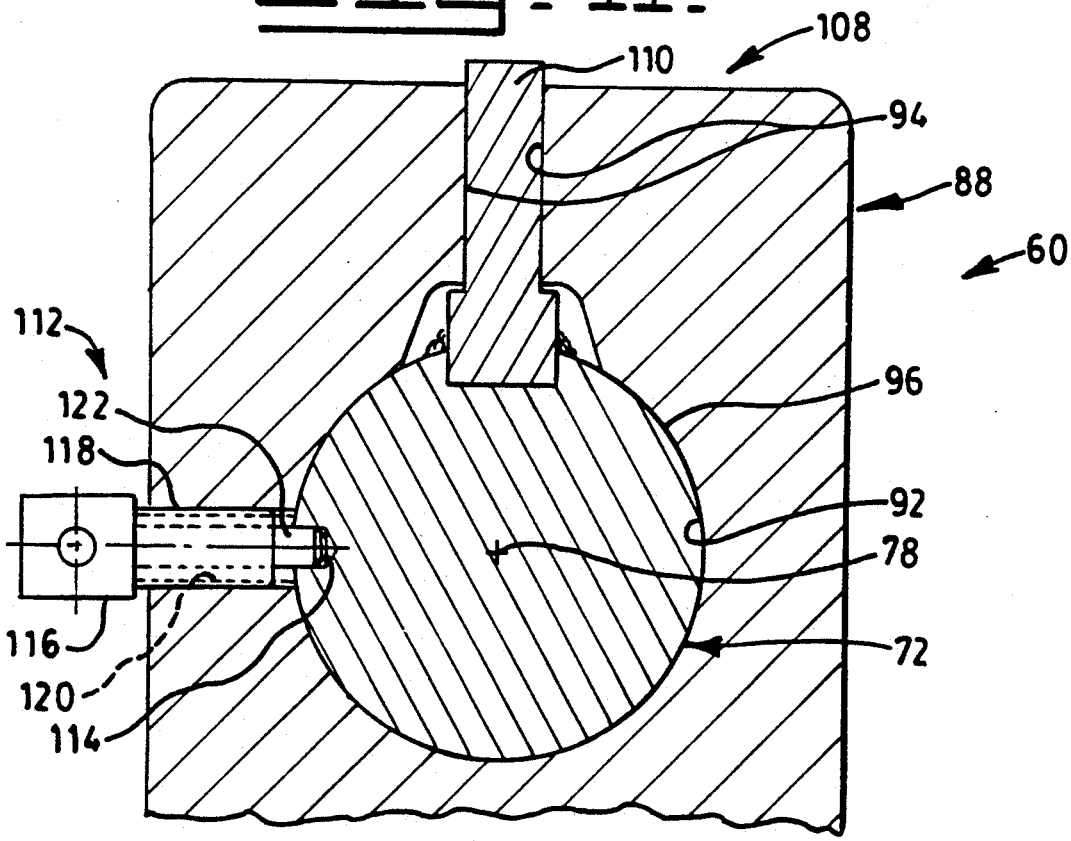
FIG. 11 is a diagrammatic cross section view taken along lines 11—11 of FIG. 6.
Figure 12:
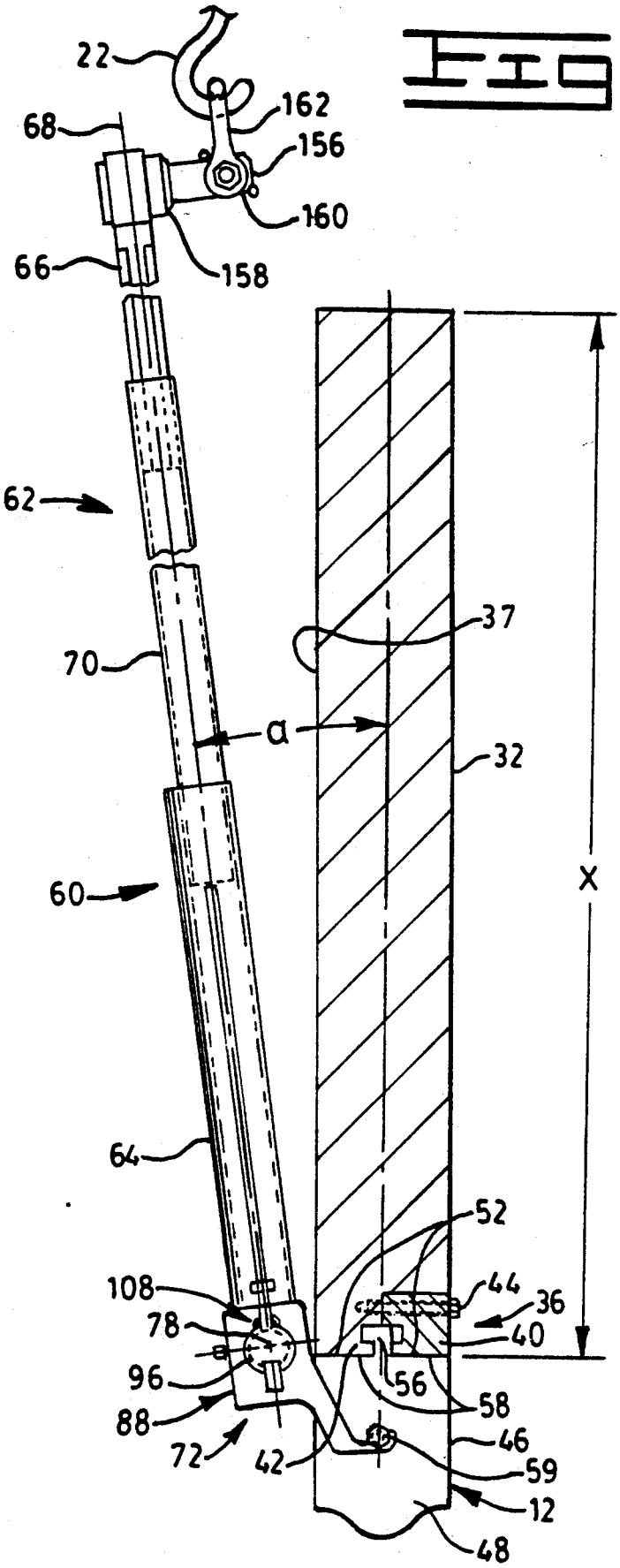
FIG. 12 is side diagrammatic view showing the lifting frame assembly at an acute angle of inclination to the ram of the machine tool during installation of the work tool on the ram.

Referring to FIG. 11, a means 108 is provided for maintaining the orientation of the first and second hooking members 88,90 to the predetermined side of the lifting frame assembly 60, for maintaining the first and second hooking members in axial alignment with each other irrespective of the axial position of the hooking members 88,90 on the second frame portion 72, and for maintaining the first and second hooking members 88,90 from rotation relative to the second frame portion 72. The means 100 includes a notch 94 disposed in the plate stock of each of the hooking members 88,90. The notch 94 passes through the plate stock and opens into the bore 92. The means 108 also includes webs 110 connected to the enlarged cylindrical end 96 of the first and second end portions 74,76 and the middle portion 80 in any suitable manner such as by welding. The webs 110 are radially oriented, axially aligned, extend in the direction of the axis 78, and extend a predetermined radial distance from the cylindrical end and outer surfaces 96,98. The webs 110 are disposed in the notches 94 and engaged with the first and second hooking members 88,90. This prevents rotation of the first and second hooking members 88,90 about the longitudinal axis 78.

Means 112 is provided for releasably connecting the first and second hooking members 88,90 to the second frame portion 72 and for maintaining the first and second hooking members 88,90 from slidable axial movement along the second frame portion 72. Preferably the releasable connecting means 112 includes a plurality of apertures 114 radially disposed in the second frame portion 72 at axially spaced apart locations along the second frame portion 72. Specifically the apertures 114 are disposed in the middle portion 80 and the enlarged end 96 of the first and second end portions 74,76. The releasable connecting means 112 further includes a detent 116 connected to each of the the first and second hooking members 88,90. As best seen in FIG. 11, the detent 116 has a housing 118 which is screwthreadably disposed in a threaded aperture 120 opening in said bore 92 and a pin 122 slidably axially disposed in the housing 118 and axially movable relative to the respective first and second hooking members 88,90. Each of the pins 122 is movable into a selected one of the apertures 114 and maintains the first and second hooking members 88,90 from slidable axial movement along the second frame portion 72. It should be noted that the pin is preferably spring biased to an extended position in order to maintain the pin 122 in the aperture 114 and from inadvertent movement from said aperture 114. Said first and second hooking members 88,90 are axially movable along the second frame portion 72 in response to the respective pin 122 being free from disposition in the particular aperture 114.

Figure 8:
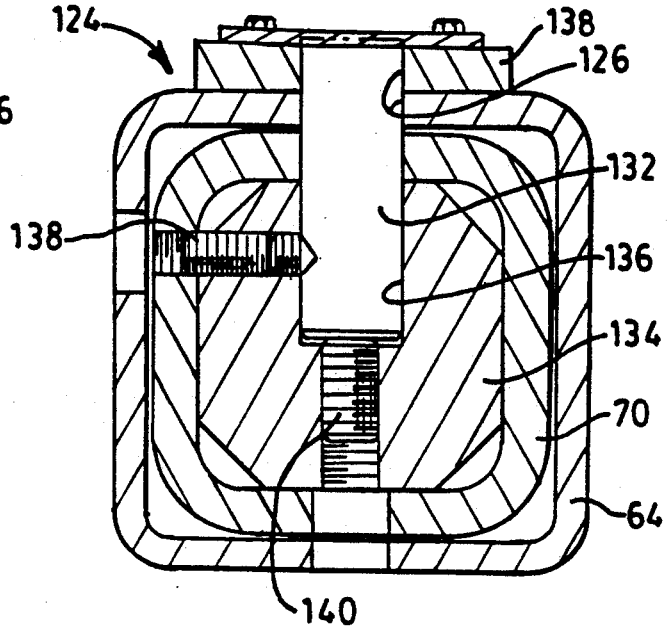
FIG. 8 is a diagrammatic cross section view taken along lines 8—8 of FIG. 7.

Referring to FIGS. 6, 7, and 8 a stop means 124 is provided for limiting movement of the first and second end portions to said predetermined extended and retracted positions. The stop means 124 includes an elongated slot 126 disposed radially in the elongated tubular member of the first end portion 64 and extends in the direction of axis 68. The slot terminates at predetermined spaced axial end locations 128,130 and defines the amount of telescopic movement of the middle portion 70 relative to the first end portion 64. The ends 128,130 (FIG. 6) of the slot 126 may be optionally defined by abutments of any suitable design located at the predetermined spaced apart axial end locations in the slot 126. As best seen in FIG. 8, a pin 132 is connected to the middle portion 70 of the first frame portion 62 by a plate 134 secured to the middle portion 70 at a predetermined location along the middle portion 70 near a lower end of the middle portion 70. The plate 134 has a bore 136 radially oriented relative to axis 68. The pin 132 is retained in the bore by set screw 138 and the amount of axial extension of the pin 132 is controllable by set screw 140. The pin 132 is disposed in the slot 126 and slides along the slot 126 during extensible movement of the middle portion 70 relative to the first end portion 64. The pin 132 engages the ends 128,130 at the retracted and extended positions, respectively. It is to be noted that an elongated bolster plate 138 is also provided with a slot 126 to provide additional structural support.

Figure 9:
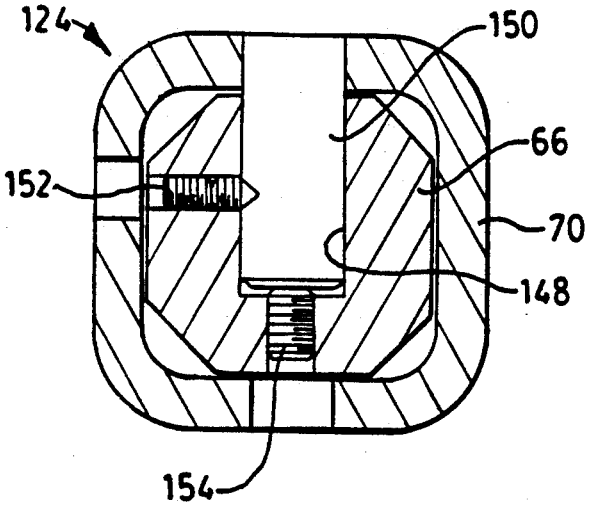
FIG. 9 is a diagrammatic cross section view taken along lines 9—9 of FIG. 7.

Referring to FIGS. 6, 7, and 9, the middle portion 70, like that of the first end portion 64 has an elongated slot 142 disposed radially therethrough and extending axially along the elongated tubular member. The slot 142 has a preselected length and an upper end 144. As best seen in FIG. 9, the elongated member defining the second end portion 66 includes a solid rectangular rod having a bore 148 disposed radially therein at a lower end portion of the second end portion 66. A pin 150 is disposed in the bore 148 by set screws 152,154. The set screw 154 determines the amount of axial extension of the pin 150 from the bore 148 and the set screw 152 prevents movement of the pin 150. The extended portion of the pin 150 is disposed in the elongated slot 142 and movable along the slot 142 a distance defined by the length of the slot 142. The pin 150 is engaged with the upper end 144 when at the extended position of the second end portion 66.

Referring to FIGS. 6, 7, and 14, a lever arm member 156 having first and second spaced end portions 158,160 is connected at the first end portion 158 to the second end portion 66 of the first frame portion 62. The lever arm member 156 extends from the first frame portion 62 to the same side of the second frame portion 72 as the first and second hooking members 88,90. The second end portion 160 of the lever arm member 156 is connectable to the hook 22 of the lifting device 18. An eye member 162, pivotally connected to the second end portion 160, facilitates connection of the hook 22 to the lever arm member 156. The lever arm member 156 has a predetermined length sufficient for maintaining the first frame portion 62 at an acute angle "a" relative to a vertical plane, such as defined by the face 37 of the ran 32, when lifted by the second end portion 160, and particularly the eye member 162. The first frame portion 62 remains at an acute angle "a" even when a die is being carried by the first and second hooking members 88,90.

Referring to FIG. 6, a means 164 is provided for releasably maintaining the first and second end portions 74,76 of the second frame portion at the retracted position. Specifically the releasable retaining means 164 includes first and second links 166,168 each having a notch 170 opening to a side of the link 166,168 and being pivotally connected to the first and second end portions 74,76, respectively, of the second frame portion 72. First and second pins 172,174 are connected to the middle portion 80 of the second frame portion 72. The first pin 172 is disposed in the notch of the first link 166 at a locking position of the first link 166 and the second pin 174 is disposed in the notch 170 of the second link 168 at a locking position of the second link 168. The first and second links 166,168 maintain the first and second end portions 74,76 of the second frame member 72 at their respective retracted positions in response to the first and second links 166,168 being at the locking position.

Figure 3:
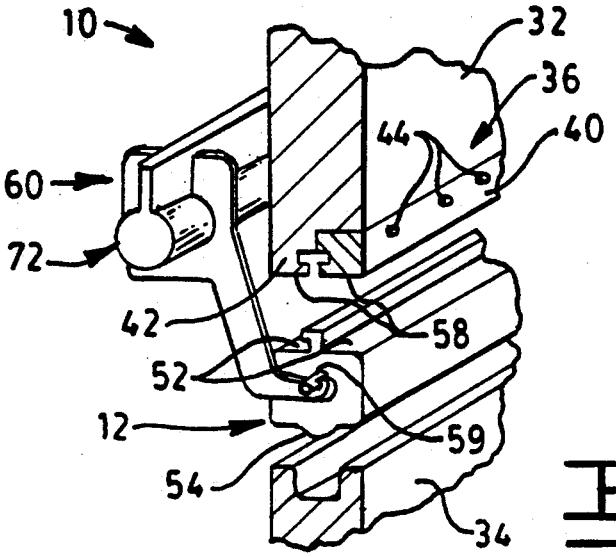
FIG. 3 is a diagrammatic enlarged isometric view of a portion of a lifting frame assembly supporting a work tool adjacent the machine tool.
Figure 4:
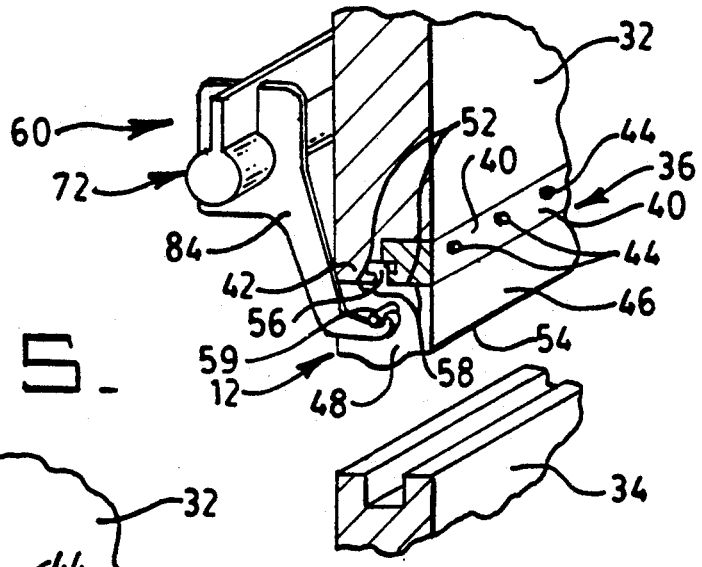
FIG. 4 is a diagrammatic enlarged isometric view of a portion of the work tool connected to the machine tool and the lifting frame assembly supporting the work tool.
Figure 5:
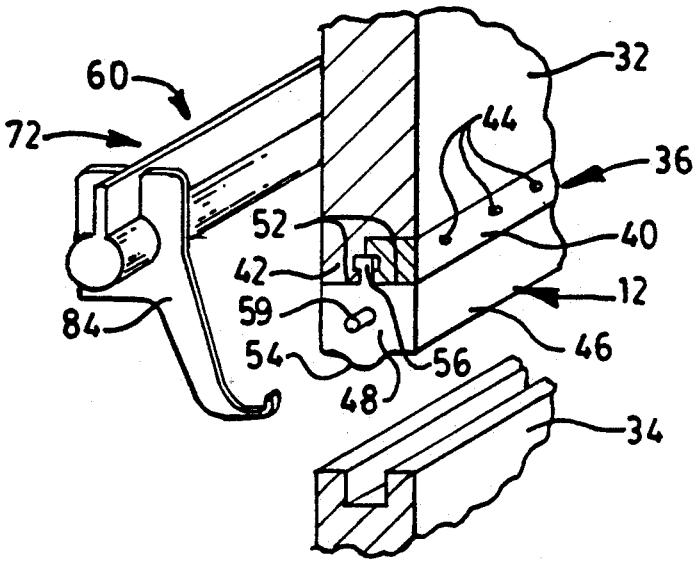
FIG. 5 is a diagrammatic enlarged isometric view of a portion of the work tool connected to the machine tool and the lifting frame assembly free from connection to the work tool.

Referring to FIGS. 1-2 in which the sequence of the method of transferring a die 12 from a storage rack 14 to a machine tool 16 is shown and FIGS. 3-5 in which the sequence of mounting the die 12 on the machine tool 16 is shown. A method for transporting a die 12 having first and second extensions 59,61 by a lifting frame assembly 60 from a stored location 14 to a location adjacent a ram 32 of a press 16 comprises extending the first end portion 62 of the lifting frame assembly 60 from the retracted position to the extended position and elevating the second frame portion 72 of the lifting frame assembly 60 to a desired height. Positioning the second frame portion 72 of the lifting frame assembly 60 to a location adjacent the die 12 to be lifted. Connecting the first and second spaced hooking members 88,90 to the first and second die extensions 59,61. Elevating the lifting frame assembly 60 and the die 12 to a desired height. Moving the die 12 to a location adjacent the ram 32 of the press 16. Clamping the die 12 to the ram 32 and removing the lifting frame assembly 60 from connection with the first and second die extensions 59,61.

The method further includes connecting the lever arm member 156 to the lifting member 20. Actuating the hoist 18 and moving the first frame portion 62 to an extended position relative to the second frame portion 72 of the lifting frame assembly 60 and lifting the second frame portion 72 in response to the first frame portion 62 being at the extended position and during subsequent elevational movement of the lifting member 20.

The method also includes the step of moving the first and second hooking members 88,90 transversely relative to the first frame portion 62 and to positions at which the first and second hooking members 88,90 are spaced to engage the first and second die extensions 59,61.

Industrial Applicability

With reference to the drawings, the lifting arrangement 10 enables a work tool 12 to be carried and transported between a stored location 14 and a machine tool 16 with ease and simplicity not before available. The lifting frame assembly 60 by virtue of the first and second hooking members 88,90 is easily connected to or released from the work tool 12.

Since the transverse axial position of the first and second hooking members 88,90 on the second frame portion 72 is easily adjustable the lifting frame assembly 60 is capable of carrying an assortment of dies 12 of different sizes, shapes, and lengths. The adjustment of the first and second hooking members 88,90 is achieved by simply pulling the pin 122 from disposition in the apertures 114 and sliding the hooking members 88,90 to the desired axial locations. Because the detent 122 is positive acting inadvertent movement of the first and second hooking members 88,90 is prevented.

Because the first and second end portions 74,76 of the second frame portion 72 are telescopically extensible relative to the middle portion 80 extremely long dies may be handled with ease. In such applications the first and second hooking members 88,90 are connected to the enlarged end portions 96 of the first and second end portion 74,76 by the detents 122.

The orientation means 108 enables the first and second hooking members 88,90 to be axially positioned along the second frame portion while maintaining the hooking members 88,90 from rotation relative to the second frame portion 72. In this regard the rotation stopping means 100 eliminates the potential for rotation of the first and second end portions 74,76 irrespective of the extended position thereof. Thus the first and second hooking members 88,90 are positively maintained at the proper location on the same side of the lifting frame assembly 60 and in alignment with each other so that the first and second extensions 59,61 may carry the work tool at the proper attitude.

As best seen in FIG. 14, because the first frame portion 62 is extendable a distance greater than "X" interference between the ram 32 is prevented and the work tool 12 may be easily positioned between the ram 32 and table 34. The relative positions of the first and second hooking members 88,90 and the lever arm member 156 further improves positioning of the work tool 12 by maintaining the lifting frame assembly at an acute angle "a" relative to the face 37 of the work tool 12. This enables the work tool 12 to hang beneath the ran 32 with little or no assistance on the part of the operator.

Other aspects, objects and advantages of the present invention can be obtained from a study of the drawings, the disclosure and the appended claims.

I claim:

1. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion;

first and said second spaced hooking members connected to the second frame portion, oriented transversely relative to the longitudinal axis of the second frame portion, and to a predetermined side of the lifting frame assembly, said first and second hooking members being adapted to engage and carry a metal forming tool to said predetermined side of the lifting frame assembly;

a lever arm member having first and second spaced end portions and being connected at the first end portion thereof to the second end portion of the first frame portion, said lever arm member extending from the first frame portion to the same side of the second frame portion as the first and second hooking members;

means for connecting said second end portion of the lever arm member to an elevationally movable lifting device, said connecting means including flexible means for permitting free swinging movement of the lifting frame assembly, said lever arm extending a predetermined distance to the same side of the second frame portion as the hooking members and causing said first frame portion to be suspended at an acute angle relative to the longitudinal axis of the first frame portion and a vertical plane.

2. A lifting frame assembly for connecting an elevationally movable lifting device to a metal working tool, comprising:

a first frame portion having first and second spaced end portions and a longitudinal axis extending between the first and second spaced end portions, said first and second spaced portions being movable relative to each other along said longitudinal axis between predetermined extended and retracted positions, said first frame portion including a plurality of elongated members slidably telescopically connected to each other, one of said elongated members of the first frame portion including said first end portion and another of said elongated members of the first frame portion including said second end portion, said first frame portion having a stop means for limiting movement of the first and second end portions to said predetermined extended and retracted positions, one of said elongated members being tubular and said stop means including an elongated slot having an end and being disposed radially in said tubular elongated member, said elongated slot extending axially along said tubular elongated member, and a pin connected to an other of the elongated members and disposed in the elongated slot, said pin being engageable with the end of the elongated slot at the extended position of the other elongated member;

a second frame portion having a longitudinal axis, said second frame portion being connected to the first end portion of the first frame portion and extending axially transversely relative to the longitudinal axis of the first frame portion;

first and second spaced hooking members connected to the second frame portion, oriented transversely relative to the longitudinal axis of the second frame portion, and to a predetermined side of the lifting frame assembly, said first and second hooking members being adapted to engage and carry a metal forming tool;

a lever arm member having first and second spaced end portions and being connected at the first end portion thereof to the second end portion of the first frame portion, said lever arm member extending from the first frame portion to the same side of the second frame portion as the first and second hooking members, said second end portion of the lever arm member being connectable to an elevationally movable lifting device.

3. A lifting frame assembly, as set forth in claim 2, wherein said plurality of elongated members of the first frame portion are rectangular in cross section.

4. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion, said second frame portion having a middle portion and first and second spaced end portions slidably connected to the middle portion and extensibly movable relative to the middle portion between retracted and extended positions;

first and second spaced hooking members connected to the second frame portion, oriented transversely relative to the longitudinal axis of the second frame portion, and to a predetermined side of the lifting frame assembly, said first and second hooking members being adapted to engage and carry a metal forming tool;

a lever arm member having first and second spaced end portions and being connected at the first end portion thereof to the second end portion of the first frame portion, said lever arm member extending from the first frame portion to the same side of the second frame portion as the first and second hooking members, said second end portion of the lever arm member being connectable to an elevationally movable lifting device.

5. A lifting frame assembly, as set forth in claim 4, wherein the second frame portion middle portion includes a tubular member having a cylindrical bore and said second frame portion first and second end portions are cylindrical and slidably disposed in the bore of the tubular member.

6. A lifting frame assembly, as set forth in claim 5, including means for maintaining the first and second cylindrical end portions from rotation in the cylindrical bore.

7. A lifting frame assembly as set forth in claim 6, wherein said means for maintaining the first and second cylindrical end portions from rotation includes:

first and second slots disposed in one of the middle portion of the second frame portion and the first and second cylindrical end portions of the second frame portion, respectively;

first and second ways disposed in the other of the middle portion of the second frame portion and the first and second end portions of the second frame portion, respectively; and first and second keys being disposed in the first and second slots and ways, respectively.

8. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion;

first and second spaced hooking members connected to the second frame portion, oriented transversely relative to the longitudinal axis of the second frame portion, and to a predetermined side of the lifting frame assembly, said first and second hooking members being adapted to engage and carry a metal forming tool;

means for maintaining the orientation of said first and second hooking members to said predetermined side of the lifting frame assembly and from rotation relative to the second frame portion, said means for maintaining the orientation of said first and second hooking members to said predetermined side of the lifting frame assembly including a web connected to the second frame portion and extending in the direction of the longitudinal axis, a bore disposed through each of the first and second hooking members; and a notch disposed through each of first and second hooking members and opening in the bore, said second frame portion being disposed in the bore of the first and second hooking members and said web being disposed in the notch of said first and second hooking members, said first and second hooking members each being slidably individually movable along the second frame portion;

a lever arm member having first and second spaced end portions and being connected at the first end portion thereof to the second end portion of the first frame portion, said lever arm member extending from the first frame portion to the same side of the second frame portion as the first and second hooking members, said second end portion of the lever arm member being connectable to an elevationally movable lifting device.

9. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion;

first and second spaced hooking members connected to the second frame portion, oriented transversely relative to the longitudinal axis of the second frame portion, and to a predetermined side of the lifting frame assembly, said first and second hooking members being adapted to engage and carry a metal forming tool;

means for maintaining the orientation of said first and second hooking members to said predetermined side of the lifting frame assembly and from rotation relative to the second frame portion;

means for releasably connecting said first and second hooking members to the second frame portion and maintaining said hooking members from slidable axial movement along said second frame portion, said releasable connecting means including a plurality of apertures disposed radially in the second frame portion at axially spaced apart locations along the second frame portion, and a pair of detents each having a pin and being connected one to each of the first and second hooking members, said pins being slidably axially movable relative to the first and second hooking members, said first and second hooking members being retained from axial movement in response to a respective pin being disposed in a selected one of said apertures and said first and second hooking members being axially movable along said second frame portion in response to said respective pin being free from disposition in one of said apertures; and a lever arm member having first and second spaced end portions and being connected at the first end portion thereof to the second end portion of the first frame portion, said lever arm member extending from the first frame portion to the same side of the second frame portion as the first and second hooking members, said second end portion of the lever arm member being connectable to an elevationally movable lifting device.

10. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion, said second frame portion having a middle portion and first and second spaced end portions slidably connected to the middle portion and extensibly movable relative to the middle portion between retracted and extended positions, said middle portion of the second frame portion including a tubular member having a cylindrical bore and said second frame portion first and second end portions being cylindrical and slidably disposed in the bore of the tubular member;

first and second spaced hooking members connected to the second frame portion, oriented transversely relative to the longitudinal axis of the second frame portion, and to a predetermined side of the lifting frame assembly, said first and second hooking members being adapted to engage and carry a metal forming too, said first and second hooking members being slidably supported on and axially movable along the middle, first, and second end portions of said second frame portion;

means for maintaining the first and second cylindrical end portions from rotation in the cylindrical bore;

means for maintaining the orientation of said first and second hooking members to said predetermined side of the lifting frame assembly and from rotation relative to the second frame portion;

means for releasably connecting said first and second hooking members to the second frame portion and maintaining said hooking members from slidable axial movement along said second frame portion;

a lever arm member having first and second spaced end portions and being connected at the first end portion thereof to the second end portion of the first frame portion, said lever arm member extending from the first frame portion to the same side of the second frame portion as the first and second hooking members, said second end portion of the lever arm member being connectable to an elevationally movable lifting device.

11. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion;

first and second spaced hooking members connected to the second frame portion, oriented transversely relative to the longitudinal axis of the second frame portion, and to a predetermined side of the lifting frame assembly, said first and second hooking members being adapted to engage and carry a metal forming tool;

a lever arm member having first and second spaced end portions and being connected at the first end portion thereof to the second end portion of the first frame portion, said lever arm member extending from the first frame portion to the same side of the second frame portion as the first and second hooking members, an eye member pivotally connected to the second end portion of the lever arm; said eye member connecting an elevationally movable lifting device to the second end portion of the lever arm, said lever arm member having a predetermined length sufficient for maintaining the first frame portion at an acute angle relative to a vertical plane when supported by the second end portion of the lever arm.

12. A lifting frame assembly for connecting an elevationally movable lifting device to a metal working tool, comprising:

a first frame portion having first and second spaced end portions and a longitudinal axis extending between the first and second spaced end portions, said first and second end portions being movable relative to each other along said longitudinal axis between predetermined extended and retracted positions;

a second frame portion having a longitudinal axis, said second frame portion being connected to the first end portion of the first frame portion and extending axially transversely relative to the longitudinal axis of the first frame portion, said second frame portion having a middle portion and first and second spaced end portions slidably connected to the middle portion and extensibly movable relative to the middle portion between retracted and extended positions;

means for releasably maintaining the first and second end portions of the second frame portion at the retracted position;

first and second spaced hooking members connected to the second frame portion, oriented transversely relative to the longitudinal axis of the second frame portion, and to a predetermined side of the lifting frame assembly, said first and second hooking members being adapted to engage and carry a metal forming tool;

a lever arm member having first and second spaced end portions and being connected at the first end portion thereof to the second end portion of the first frame portion, said lever arm member extending from the first frame portion to the same side of the second frame portion as the first and second hooking members, said second end portion of the lever arm member being connectable to an elevationally movable lifting device.

13. A lifting frame assembly, as set forth in claim 12, wherein said releasable maintaining means includes:

first and second links each having a notch opening to a side of the link and being pivotally connected to the first and second end portions, respectively, of the second frame portion; and first and second pins connected to the middle portion of the second frame portion, said first pin being disposed in the notch of the first link at a locking position the first link and a second pin disposed in the notch of the second link at a locking position of the second link, said first and second links maintaining the first and second end portions of the second frame member at the retracted positions in response to being at the locking position.

14. A lifting arrangement, comprising:

a lifting device having an elevationally movable lifting member;

a machine tool having an elevationally movable ram, a table spaced beneath the ram, and a tool holder connected to the ran, said tool holder being elevationally located between the ram and table;

a metal working tool having a connecting portion and being connectable to the tool holder;

a lifting frame assembly having first and second frame portions, first and second hooking members, and a lifting arm, said first frame portion having first and second end portions relatively movable between extended and retracted positions, said second frame portion having first and second spaced end portions, said second frame portion being connected to the first end portion of the first frame portion and said first and second hooking members being connected to the first and second end portions, respectively, of the second frame portion, said first and second hooking members extending from the second frame portion on a preselected side of the lifting frame assembly, said lever arm member having first and second end portions and being connected at the first end portion thereof to the second end portion of the first frame portion, said lever arm member extending transversely relative to the first frame portion on the preselected side of the lifting frame;

said second end portion of the lever arm member being connected to the elevationally movable lifting member, said first frame portion being movable from the retracted position to the extended position in response to elevational movement of the lifting member, said second frame portion being elevationally movable in response to subsequent elevational movement of the lifting member, said first and second hooking members connecting the metal working tool to the second frame portion and facilitating selective alignment of the metal working tool relative to the tool holder.

15. A lifting arrangement, as set forth in claim 14, wherein said first frame portion includes a plurality of tubular members slidably telescopically connected to each other.

16. A lifting arrangement, as set forth in claim 15, wherein said first frame portion includes a rod slidably telescopically disposed in one of the plurality of tubular members, said first portion of the first frame portion including one of the plurality of tubular members and said second portion of the first frame portion including the rod.

17. A lifting arrangement, as set forth in claim 15, wherein said first and second hooking members being movable relative to each other in directions transverse a longitudinal axis of the plurality of telescopic members of the first frame portion.

18. A lifting frame arrangement, as set forth in claim 17, wherein second frame portion includes a tubular middle portion, said first and second end portions of the second frame portion being slidably disposed in a tubular middle portion.

19. A lifting frame arrangement, as set forth in claim 15, wherein the lever arm member is of a length sufficient to maintain the first frame portion at an acute angle "a" to a vertical plane with the metal working tool being elevationally supported on the first and second hooking members and the lifting frame assembly being hung on the lifting member.

20. A lifting frame arrangement, as set forth in claim 18, including means for releasably connecting said first and second hooking members for sliding movement along the first, second and middle portions of the second frame portion.

21. A lifting frame arrangement, as set forth in claim 18, including:

means for maintaining the first and second end portions of the second end portion from rotation relative to the middle portion;

means for maintaining the orientation of said first and second hooking members to said predetermined side of the lifting frame assembly and from rotation relative to the second frame portion;

22. A lifting arrangement for supporting a die at a preselected location relative to a lower end of a ram of a press, comprising:

a crane having an elevationally movable lifting member;

said ram having an upper end elevationally spaced from the ram lower end and a die holding clamp at the lower end;

said die having first and second spaced extensions, a connecting portion, and being connectable at the connecting portion to the ram lower end;

a lifting frame assembly having first and second connected frame portions, said first frame portion having an end portion and being telescopically extensible between extended and retracted positions, first and second spaced hooking members connected to the second frame portion;

a lifting arm connected to the end portion of the first frame portion, said hooking members and lifting arm being oriented to a common side of the frame assembly to enable the die to be easily positioned easily beneath the lower end of the ram, said elevationally movable lifting member being connected to the lifting arm and said first and second spaced hooking members being engageable with the first and second extensions, said first frame portion being adapted to traverse the distance between the upper and lower ends of the ram at the extended position and support the die to be positioned adjacent the lower end of the ram, said die being connectable to the ram by the die holding clamp.

23. A method for transporting a die having first and second extensions by a lifting frame assembly from a stored position to a position adjacent a ram of a press, the lifting frame assembly having a first telescopic frame portion and a second frame portion connected to the first frame portion, first and second relatively movable hooking members connected to the second frame portion, comprising the steps of;

extending the first frame portion elevationally telescopically from a retracted position to an extended position;

elevating the second frame portion of the lifting frame assembly to a desired height;

positioning the second frame portion of the lifting frame assembly at a location adjacent the die to be lifted;

hookingly connecting the first and second spaced hooking members to the first and second die extensions;

elevating the second frame portion to a desired height;

moving the die to a location adjacent to and beneath the ram of the press;

clamping the die to the ram; and removing the lifting frame assembly from connection with the first and second die extensions.

24. A method, as set forth in claim 23, including a hoist having a lifting member, said lifting frame assembly having a lever arm connected to the first end portion of the first frame portion, including the steps of:

connecting the lever arm to the lifting member of the hoist;

actuating the hoist and moving the first frame portion relative to the second frame portion and to the extended position; and lifting the second frame portion in response to the first frame portion being at the fully extended position and during subsequent elevational movement of the lifting member of the hoist.

25. A method, as set forth in claim 24, wherein the lever arm and first and second hooking members are positioned on a common side of the lifting frame assembly, said lever arm causing said frame to hang from the lifting member at an acute angle relative to a vertical plane defined by the surface of the ram and position the die beneath an end of the ram.

26. A method, as set forth in claim 23, wherein said first and second hooking members being movable transversely relative to the directions of extensible movement of the first frame portion, and including the step of moving the first and second hooking members transversely relative to the first frame portion to positions at which the first and second hooking members are spaced to engage the first and second die extensions.

* * * * *